US009362645B2

(12) United States Patent
Meunier

(10) Patent No.: US 9,362,645 B2
(45) Date of Patent: Jun. 7, 2016

(54) ONE PIECE SOCKET CONTACT

(71) Applicant: Robert Meunier, Sturbridge, MA (US)

(72) Inventor: Robert Meunier, Sturbridge, MA (US)

(73) Assignee: Hypertronics Corporation, Hudson, MA (US)

( * ) Notice: Subject to any disclaimer, the term of this patent is extended or adjusted under 35 U.S.C. 154(b) by 100 days.

(21) Appl. No.: 14/073,758

(22) Filed: Dec. 5, 2013

(65) Prior Publication Data

US 2015/0162687 A1 Jun. 11, 2015

(51) Int. Cl.
*H01R 13/04* (2006.01)
*H01R 43/16* (2006.01)
*H01R 13/11* (2006.01)

(52) U.S. Cl.
CPC ..... *H01R 13/04* (2013.01); *H01R 13/111* (2013.01); *H01R 43/16* (2013.01); *Y10T 29/49218* (2015.01)

(58) Field of Classification Search
CPC ..... H01R 13/111
USPC ..... 439/851, 843
See application file for complete search history.

(56) References Cited

U.S. PATENT DOCUMENTS 1,833,145 A * 11/1931 Wilhelm ..... H01R 13/193 403/299
2,450,529 A * 10/1948 Sprigg ..... 29/876
3,314,044 A * 4/1967 Powell ..... 439/851
4,128,293 A * 12/1978 Paoli ..... H01R 13/187 439/827
4,203,647 A * 5/1980 Bonhomme ..... 439/851
4,304,457 A * 12/1981 Lissau ..... H01R 13/111 439/682
4,345,373 A * 8/1982 Lacaze, Jr. ..... 29/874
4,447,108 A * 5/1984 Ghigliotti et al. ..... 439/851
4,572,606 A * 2/1986 Neumann et al. ..... 439/843
4,720,157 A * 1/1988 Nestor et al. ..... 439/851
4,840,587 A * 6/1989 Lancella ..... 439/851
5,055,055 A * 10/1991 Bakker ..... H01R 9/091 29/883
5,921,822 A * 7/1999 Kennedy ..... H01R 13/187 439/851
6,358,104 B2 * 3/2002 Daugherty et al. ..... 439/851
6,520,998 B1 * 2/2003 Scholler et al. ..... 439/851
6,656,002 B2 * 12/2003 Zhao et al. ..... 439/851
6,860,768 B2 * 3/2005 Zhao ..... H01R 11/22 439/843
7,331,821 B2 * 2/2008 Feldman ..... H01R 9/05 439/578
7,387,548 B2 * 6/2008 Takehara ..... H01R 13/187 439/843
7,931,509 B2 * 4/2011 Shaw ..... H01R 13/111 439/851
8,079,885 B1 * 12/2011 Lin ..... H01R 13/111 439/851
9,017,089 B2 * 4/2015 Flower et al. ..... 439/345
9,236,682 B2 * 1/2016 Glick ..... H01R 13/62
2015/0162687 A1 * 6/2015 Meunier ..... H01R 13/111 439/884

* cited by examiner

*Primary Examiner* — Neil Abrams
(74) *Attorney, Agent, or Firm* — Snell & Wilmer LLP

(57) ABSTRACT

A one piece socket contact for receiving a pin. The socket contact includes a tubular barrel having a rear tail portion, a ferrule portion, and a throat portion. The ferrule portion includes an opening with an opening diameter. The throat portion has a plurality of slots that define a plurality of bands. The bands are bent inwards to a throat diameter smaller than the opening diameter. The bands are arranged to resemble a hyperboloid wire cage.

20 Claims, 7 Drawing Sheets

ONE PIECE SOCKET CONTACT

BACKGROUND

1. Field

The present disclosure relates to a socket contact for receiving a pin. More particularly, the present disclosure relates to a socket contact made of a single piece for simple manufacturing.

2. Description of the Related Art

Socket contacts receive a pin in order to create an electrical connection. The socket contact receives and snugly holds the pin to create a reliable connection. Socket contacts often utilize a hyperboloid wire cage to receive the pin. A hyperboloid wire cage comprises several wires arranged around the diameter in a hyperboloid shape, resembling two cones merged at the tips. When the pin is inserted into the hyperboloid wire cage, the pin slides along the wires, which contact the surface of the pin as well as hold the pin in place. The hyperboloid wire cage provides a generally even connection around the pin, and may contact more surface area—improving contact density—depending on the number of wires. The hyperboloid wire cage may further guide the pin to a proper insertion.

The hyperboloid wire cage is made from several wires arranged around a ring. Assembling a socket contact with a hyperboloid wire cage requires machining several parts, such as a forward ring, a ferrule, and a tail, and placing wires in specific locations around the forward ring and the tail. The number of pieces needed and the placement of wires require complex assembly requiring specific assembly equipment. The cost to manufacture may be high because of the added requirements. Reducing the number of parts or the complexity of the hyperboloid wire cage may reduce the manufacturing cost while maintaining reliability.

SUMMARY

The present disclosure relates to a socket contact made of one piece. One aspect of the present disclosure is to provide a socket contact made of only a single piece, instead of several pieces. Another aspect of the present disclosure is to provide a simplified manufacturing process by forming a socket contact from a single piece.

In one implementation, a socket contact includes a rear tail and a ferrule having an opening configured to receive a pin. The opening has an opening diameter. The socket contact also includes a plurality of conductive bands connecting the rear tail to the ferrule. The conductive bands form a throat opening extending from the opening and tapering to a throat portion having a throat diameter. The throat diameter is smaller than the opening diameter.

In another implementation, a socket contact for mating with a pin is a tubular barrel having a first end, a second end, a rear tail portion on the first end, and a ferrule portion on the second end. The ferrule portion has an opening having an opening diameter and configured to receive the pin. A plurality of slots extend between the rear tail portion and the ferrule portion to define a plurality of bands. The plurality of bands form a throat opening extending from the opening and tapering to a throat portion having a throat diameter. The throat diameter is smaller than the opening diameter.

In yet another implementation, the present disclosure provides a method of fabricating a socket contact for mating with a pin comprising providing a tubular piece having a first end, a second end, and a sidewall, opening a hole in a center of the first end, the hole having an opening diameter, forming a plurality of slots along the sidewall to form a plurality of bands, and reshaping the plurality of bands to form a throat opening tapering to a throat portion having a throat diameter smaller than the opening diameter.

BRIEF DESCRIPTION OF THE DRAWINGS

The features, obstacles, and advantages of the present application will become more apparent from the detailed description set forth below when taken in conjunction with the drawings, wherein.

DETAILED DESCRIPTION

Apparatus, systems and methods that implement the implementations of the various features of the present application will now be described with reference to the drawings. The drawings and the associated descriptions are provided to illustrate some implementations of the present application and not to limit the scope of the present application. Throughout the drawings, reference numbers are re-used to indicate correspondence between referenced elements.

Figure 1A:
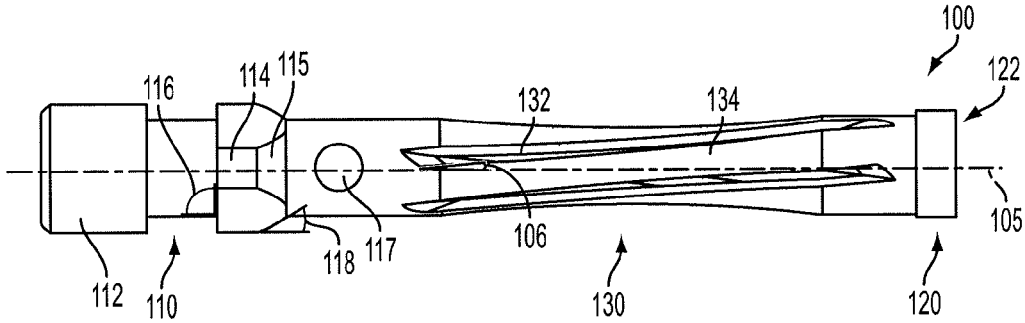
FIG. 1A is a side view of a one piece socket contact according to an implementation of the present disclosure.
Figure 1B:
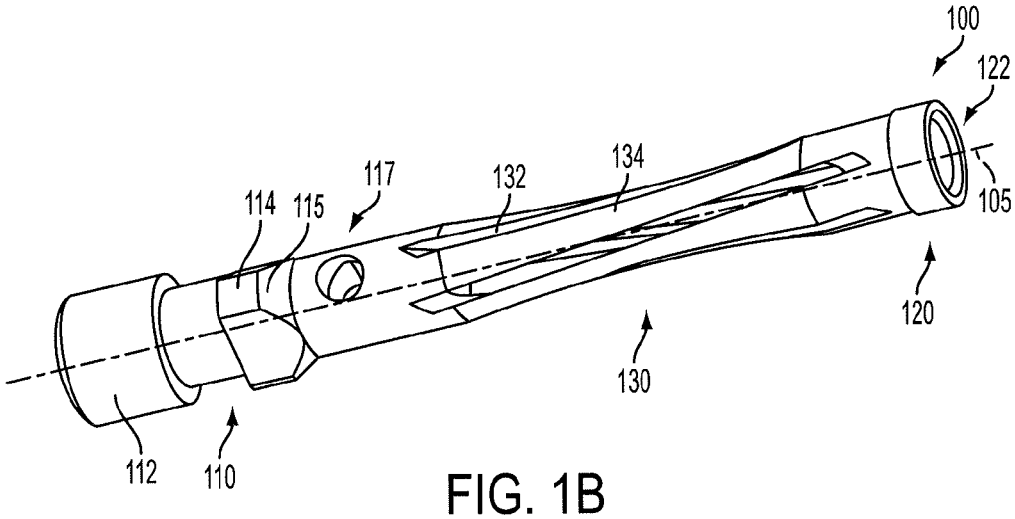
FIG. 1B is another view of the one piece socket contact of FIG. 1A according to an implementation of the present disclosure.
Figure 1C:
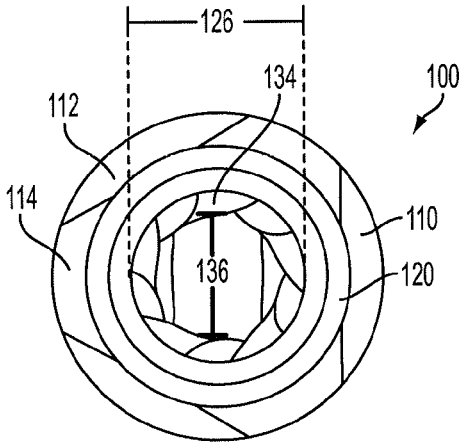
FIG. 1C is an end view through a center of the one piece socket contact of FIG. 1A according to an implementation of the present disclosure.

In one implementation, shown in FIGS. 1A-1C, a socket contact 100 is a single machined piece. The single machined piece may be made from metal, such as phosphorus, bronze, beryllium, copper, or other conductive material on a screw machine or other similar apparatus. The socket contact 100 includes a rear tail portion 110 at a first end of the socket contact 100 and a ferrule portion 120 at a second or opposite end of the socket contact 100. A central axis 105 extends through the center of the socket contact 100, from the first end to the second end.

The rear tail portion 110 includes a protrusion 112, and one or more protrusions 114. The protrusion 114 may be formed at an angle 116, such as 90 degrees, from the rear tail portion 110. The protrusion 114 may also have a sloping portion 115 at an angle 118, such as 30 degrees. The ferrule portion 120 includes an opening 122, having an opening diameter 126, as seen in FIG. 1C. The opening 122 generally extends through the socket contact 100, ending near a hole 117 adjacent the rear tail portion 110. A throat portion 130 extends between the rear tail portion 110 and the ferrule portion 120. The throat portion 130 includes a plurality of slots 132, which define a plurality of bands 134. The throat portion 130 defines a throat opening which is continuous with the opening 122.

The plurality of bands 134 are arranged radially around the central axis 105. The plurality of bands 134 bends slightly inwards towards the central axis 105 near a center or midpoint along the length of the bands 134. A throat diameter 136 is the smallest throat opening diameter. As seen in FIG. 1C, the throat diameter 136 is less than the opening diameter 126. In addition, because the slots 132 are formed at an angle 106 with respect to the central axis 105, the bands 134 are also at the angle 106 with respect to the central axis 105. More specifically, if a plane extended out from the central axis 105 to the throat portion 130, the slots 132 and the bands 134 would form the angle 106 with that plane. Accordingly, the bands 134 are arranged in a hyperboloid shape resembling a hyperboloid wire cage and function similar to a hyperboloid wire cage in that the bands 134 provide multiple contact points along a mated pin, 360 degrees of contact, as well as mechanical stability. The bands 134 are advantageously simpler to manufacture than a hyperboloid wire cage, as will be described below.

Figure 2A:
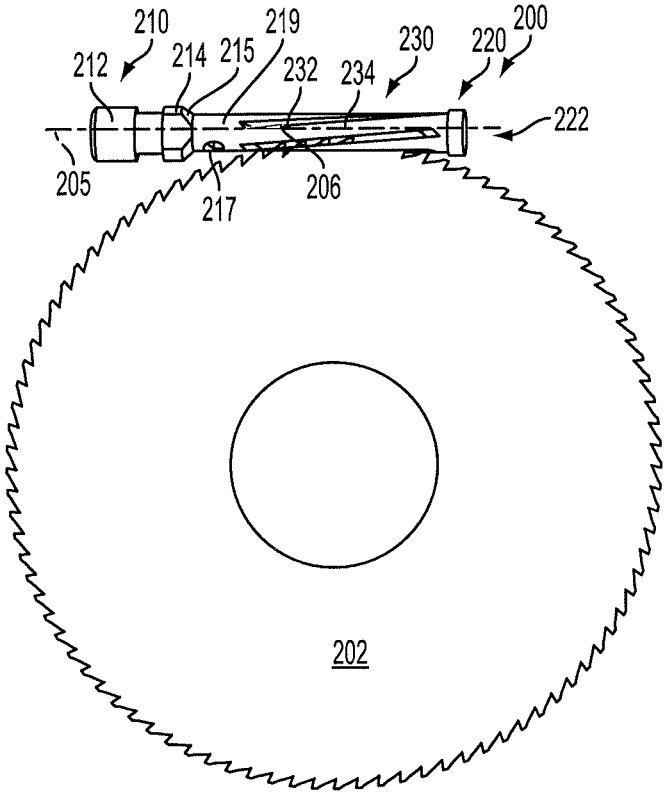
FIG. 2A depicts forming slots in a tubular barrel according to an implementation of the present disclosure.
Figure 2B:
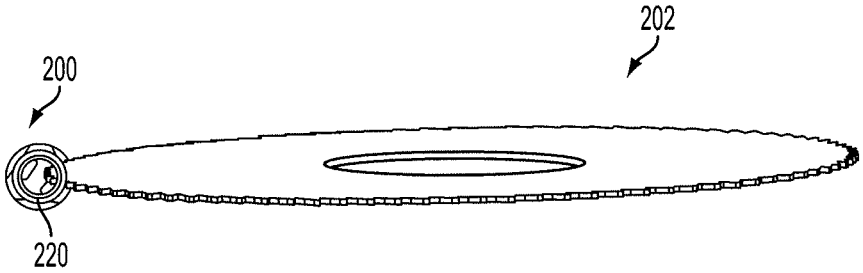
FIG. 2B depicts another view of FIG. 2A according to an implementation of the present disclosure.

FIGS. 2A and 2B depict views of forming slots in a barrel. Specifically, a tubular barrel 200 corresponds to an unfinished socket contact 100, wherein similarly numbered or named features correspond to the features of the socket contact 100. The tubular barrel 200 may have started as a metal rod having a central axis 205, cut to a required length. An opening 222 may be drilled through one of the rods, forming the tubular barrel 200. A hole 217 may be drilled in a sidewall 219 of the tubular barrel 200. The tubular barrel 200 may be placed in a lathe or similar machine to form a rear tail portion 210 having a protrusion 212 and one or more protrusions 214 with sloping portions 215 and a ferrule portion 220.

A throat portion 230 extends between the rear tail portion 210 and the ferrule portion 220. Unlike the throat portion 130, the throat portion 230 is straight and not bent or curved. Slots 232 define bands 234. A saw 202 cuts the tubular barrel 200 along the sidewall 219 to form the slots 232. The slots 232 are cut at an angle 206 with respect to the central axis 205. As seen in FIG. 2B, the saw 202 is tilted with respect to the tubular barrel 200 in order to cut the slots 232 at the angle 206. In other implementations, the angle 206 may be any other needed angle, including 0 degrees, i.e., straight. The angle 206 allows the bands 234 to wipe the whole surface of a mating pin as well as wrap around the mating pin, similar to the wires of a hyperboloid wire cage. The angle 206 may be up to 10 degrees, depending on the desired wipe action. Steeper angles, including greater than 10 degrees, may provide more engagement. The number of slots 232 may also depend on the application. Less slots 232 produce wider or thicker bands 234.

Figure 3A:
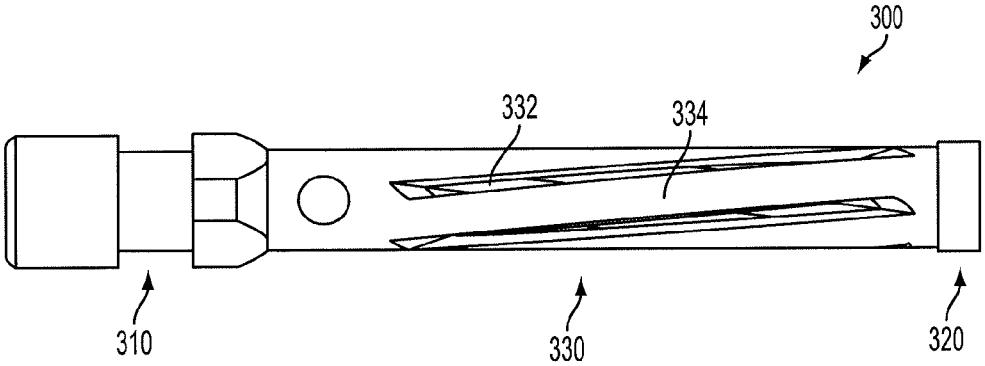
FIG. 3A is a side view of a tubular barrel having slots according to an implementation of the present disclosure.
Figure 3B:
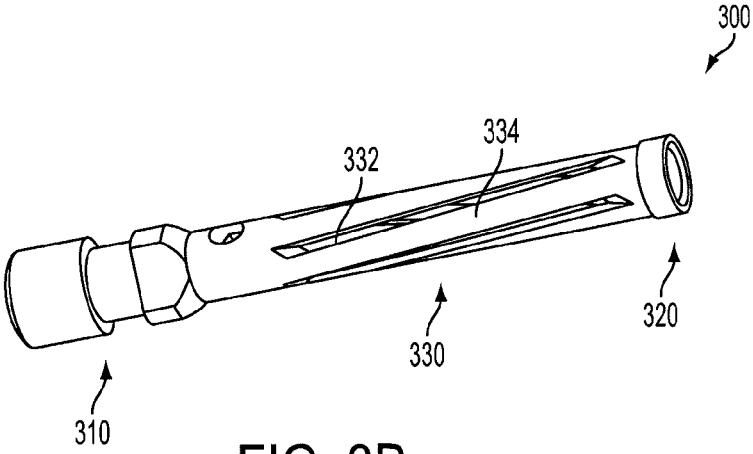
FIG. 3B is another view of the barrel of FIG. 3A according to an implementation of the present disclosure.
Figure 3C:
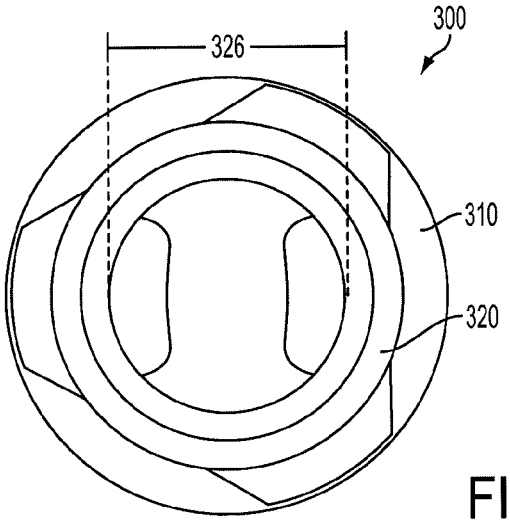
FIG. 3C is an end view through a center of the barrel of FIG. 3A according to an implementation of the present disclosure.

FIGS. 3A-3C depict a tubular barrel 300, corresponding to an unfinished socket contact 100, specifically after slots have been cut. The tubular barrel 300 includes a rear tail portion 310, a ferrule portion 320, and a throat portion 330. Slots 332 define bands 334. The tubular barrel 300 corresponds to the tubular barrel 200 after all slots 332 have been cut. The throat portion 330 is unbent. As seen in FIG. 3C, the tubular barrel 300 has an opening diameter 326, which extends through the throat portion 330. Because the bands 334 are not bent, there is no corresponding throat diameter.

Figure 4A:
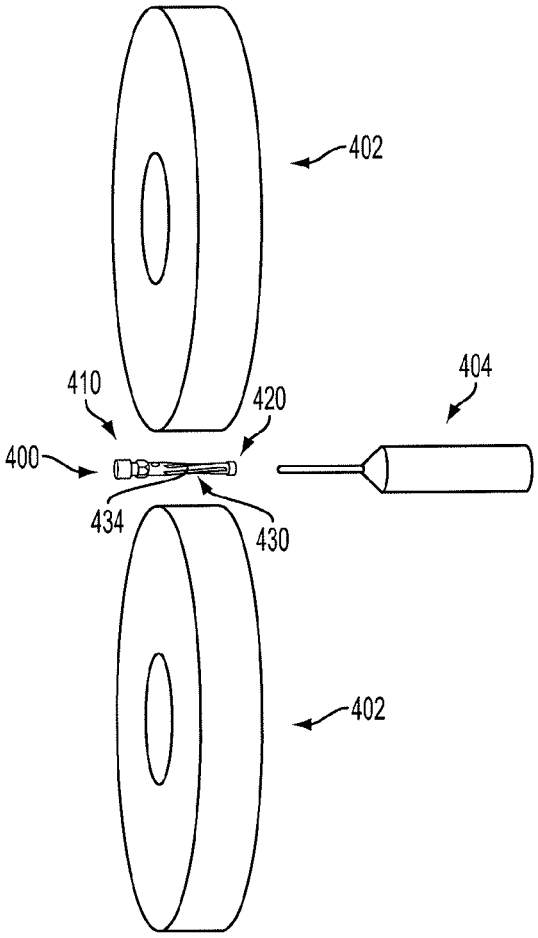
FIG. 4A is a view of a step in a roll-forming process according to an implementation of the present disclosure.
Figure 4B:
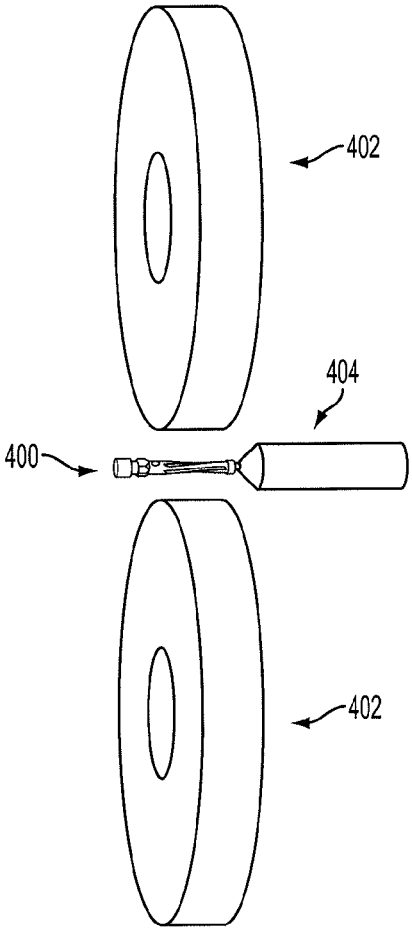
FIG. 4B is a view of another step in a roll-forming process according to an implementation of the present disclosure.
Figure 4C:
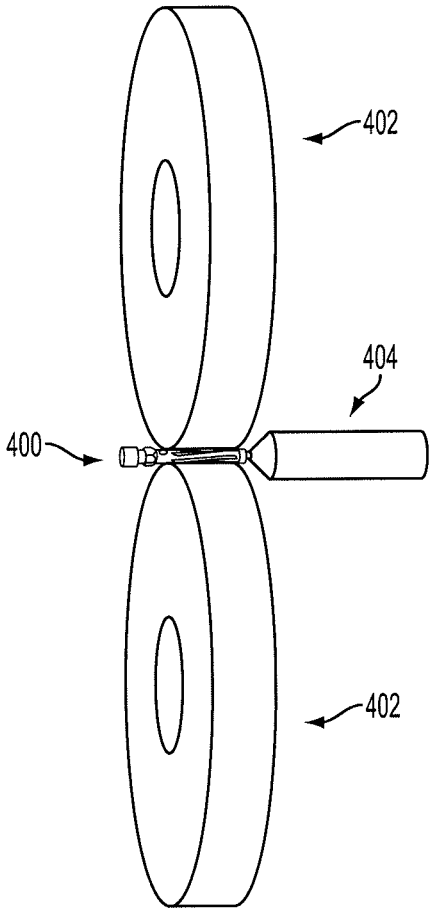
FIG. 4C is a view of another step in a roll-forming process according to an implementation of the present disclosure.

FIGS. 4A-4C illustrate a roll-forming process according to an implementation. In other implementations, the socket contact may be reshaped by other processes. FIG. 4A shows a tubular barrel 400, a rod 404, and rollers 402. The tubular barrel 400 corresponds to the tubular barrel 300, and includes a rear tail portion 410, a ferrule portion 420, and a throat portion 430 having bands 434. The rod 404 is configured to have a diameter corresponding to a desired throat diameter. In certain implementations, the rod 404 may be staggered or stepped to have two diameters, a smaller diameter corresponding to the desired throat diameter, and a larger diameter corresponding to an opening diameter. In other implementations, the rod 404 may not be used.

In FIG. 4B, the rod 404 is inserted into the tubular barrel 400. Then, at FIG. 4C, the rollers 402 converge on the throat portion 430 to bend the bands 434 by rolling the tubular barrel 400 between the rollers 402.

Figure 5A:
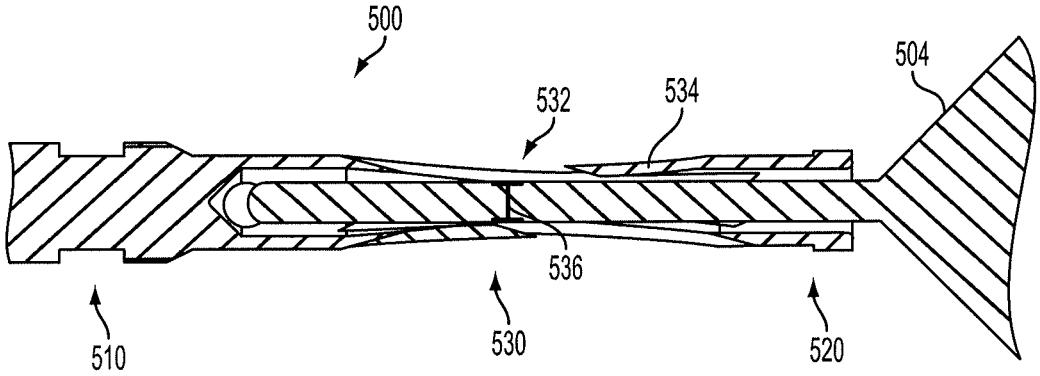
FIG. 5A is a cross-sectional side view of a socket contact according to an implementation of the present disclosure.
Figure 5B:
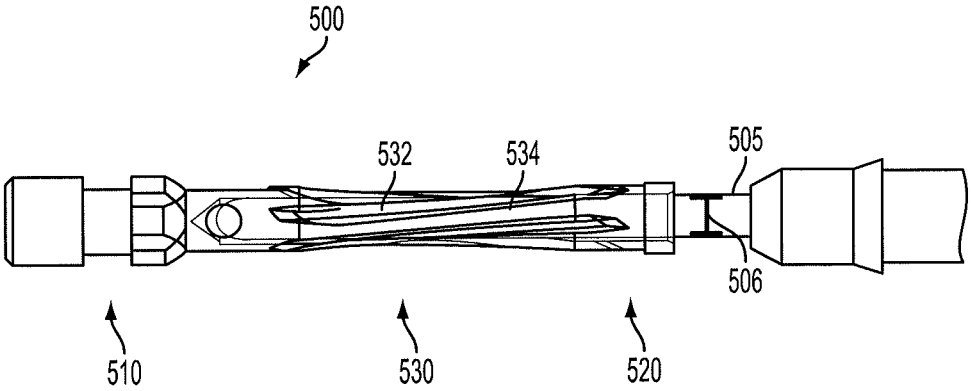
FIG. 5B is a side view of the one piece socket contact in FIG. 5A mating with a pin according to an implementation of the present disclosure.

FIG. 5A depicts a cross section of a socket contact 500, corresponding to the tubular barrel 400 after being roll-formed, and further corresponding to the socket contact 100. The socket contact 500 includes a tail portion 510, a ferrule portion 520, and a throat portion 530 including slots 532 and bands 534. The angular slots and roll-forming allows controllable and uniform contact points. As seen in FIG. 5A, the bands 534 are bent to a rod 504 having a throat diameter 536 corresponding to the desired throat diameter. FIG. 5B depicts a pin 505 having a pin diameter 506 inserted into the socket contact 500. The pin diameter 506 may be slightly larger than the throat diameter 536, to ensure good contact between the pin 505 and the bands 534, as well as to provide mechanical support by acting as a spring mechanism. The spring geometry of the bands 534 also allows for a generous lead for pin insertion.

Figure 6:
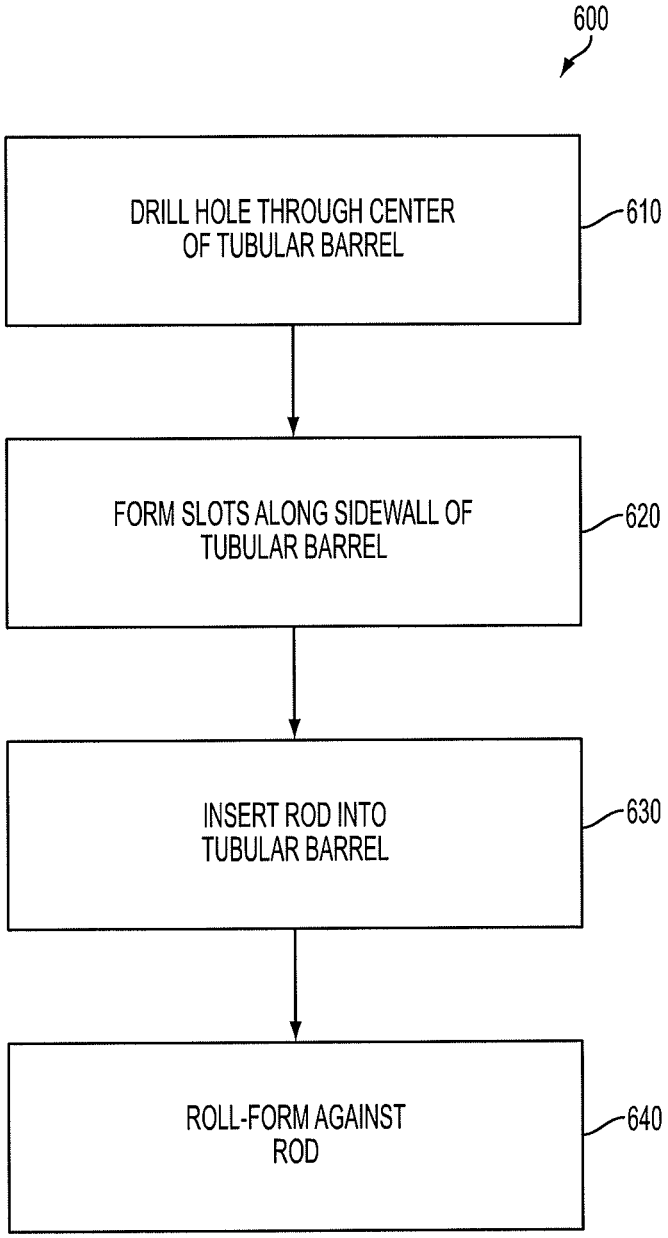
FIG. 6 is a flowchart of a manufacturing process according to an implementation of the present disclosure.

FIG. 6 presents a flowchart 600 of a fabrication process of a socket contact, such as the socket contact 100, according to an implementation of the present disclosure. The process is scalable, such that the socket contact 100 may be made smaller or larger as needed. The number of slots 132 may be determined by how small the slots 132 can be cut. A larger diameter socket contact 100, which may be used in high power applications, may require more slots 132. At 610, a hole is drilled through the center of a tubular barrel. For example, the opening 222 is drilled through the tubular barrel 200. At 620, slots are formed along a sidewall of the tubular barrel 200. For instance, the slots 232 are cut into the sidewall 219 of the tubular barrel 200. The slots may be cut at an angle, as described herein. At 630, a rod is inserted into the tubular barrel 400. FIG. 4B, for instance, shows the rod 404 inserted into the tubular barrel 400. At 640, the tubular barrel 400 is roll-formed against the rod 404. In FIG. 4C, the tubular barrel 400 is roll-formed by the rollers 402 against the rod 404. The tubular barrel 400 may undergo additional processing, such as being immersed in an acid bath to de-burr the tubular barrel 400, or being plated with a metal or other appropriate material.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described implementations are to be considered in all respects only as illustrative and not restrictive and the scope of the application is, therefore, indicated by the appended claims rather than by the foregoing description. All changes which come within the meaning and range of equivalency of the claims are to be embraced within their scope.

Various embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A socket contact having a central axis and comprising:

a rear tail;

a contiguous ferrule defining an opening having an opening diameter and that is configured to receive a pin; and a plurality of conductive bands being formed by cutting straight slots into a tubular barrel at an angle relative to the central axis such that the plurality of conductive bands is straight in an axial direction and in a circumferential direction of the socket contact, the plurality of conductive bands connecting the rear tail to the ferrule, defining a throat portion having a throat opening extending from the opening, and being rolled to bow radially inward towards a point along the throat portion that has a throat diameter that is less than the opening diameter, the cutting straight slots into the tubular barrel and the rolling of the plurality of conductive bands such that they bow radially inward providing for:

minimum loss of structural integrity of the plurality of conductive bands, and an inner surface of the plurality of conductive bands to retain a curve of an inner surface of the cylinder, to retain its orientation relative to the central axis and to face the central axis.

2. The socket contact of claim 1, wherein the plurality of conductive bands extend at an angle with respect to the central axis and is arranged radially around the central axis.

3. The socket contact of claim 1, wherein the plurality of conductive bands is arranged in a hyperboloid shape.

4. The socket contact of claim 1, wherein the rear tail, the ferrule, and the plurality of conductive bands are formed from a single rod such that they are continuous.

5. The socket contact of claim 1, wherein the rear tail includes a protrusion extending radially outward.

6. The socket contact of claim 5, wherein the protrusion includes a sloping portion that slopes radially inward towards the plurality of conductive bands.

7. The socket contact of claim 1, wherein the angle of the straight slots is selected such that the inner surface of the plurality of conductive bands wipes an entire circumference of the pin when the pin is received by the plurality of conductive bands.

8. The socket contact of claim 1, wherein each of the plurality of conductive bands is untwisted.

9. A socket contact for mating with a pin comprising:

a tubular barrel having:

a first end;

a second end opposite the first end such that a central axis extends from the first end to the second end;

a rear tail portion adjacent to the first end;

a ferrule portion adjacent to the second end and defining an opening having an opening diameter and configured to receive the pin; and a plurality of bands being formed by cutting straight slots into the tubular barrel at an angle relative to the central axis such that the plurality of bands is straight in an axial direction and a circumferential direction of the tubular barrel, the plurality of conductive bands extending between the rear tail portion and the ferrule portion, defining a plurality of slots, defining a throat portion having a throat opening extending from the opening of the ferrule portion, and being rolled to bow radially inward towards a point along the throat portion, the point along the throat portion having a throat diameter that is less than the opening diameter, the cutting straight slots into the tubular barrel and the rolling of the plurality of bands such that they bow radially inward providing for:

minimal loss of structural integrity of the plurality of bands, and an inner surface of the plurality of bands to retain a curve of an inner surface of the tubular barrel, to retain its orientation relative to the central axis and to face the central axis.

10. The socket contact of claim 9, wherein the plurality of bands extends at an angle with respect to the central axis and is arranged radially around the central axis.

11. The socket contact of claim 9, wherein the plurality of bands is arranged in a hyperboloid shape.

12. The socket contact of claim 9, wherein the rear tail portion includes a protrusion extending radially outward.

13. The socket contact of claim 12, wherein the protrusion includes a sloping portion that slopes radially inward towards the plurality of conductive bands.

14. The socket contact of claim 9, wherein the angle of the straight slots relative to the central axis is selected such that the inner surface of the plurality of bands wipes an entire circumference of the pin when the pin is received by the plurality of bands.

15. The socket contact of claim 9, wherein each of the plurality of bands is untwisted.

16. A method of fabricating a socket contact for mating with a pin comprising:

providing a tubular barrel having a first end, a second end opposite the first end such that a central axis extends from the first end to the second end, and a sidewall extending from the first end to the second end;

opening a hole in a center of the second end, the hole having an opening diameter;

cutting a plurality of slots along the sidewall at an angle relative to the central axis to form a plurality of bands extending between the first end and the second end; and rolling the plurality of bands in a circumferential direction between at least two rollers such that the plurality of bands remains straight in the axial direction and the circumferential direction of the tubular barrel, defines a throat opening and bows inward in the radial direction to a point along an axial length of the plurality of bands having a throat diameter that is less than the opening diameter, the cutting the plurality of slots along the sidewall and the rolling providing for:

minimal loss of structural integrity of the plurality of bands, and an inner surface of the plurality of bands to retain a curve of an inner surface of the tubular barrel, to retain its orientation relative to the central axis and to face the central axis.

17. The method of claim 16, wherein reshaping the plurality of bands further comprises:

inserting a rod into the tubular barrel;

placing the tubular barrel between the at least two rollers; and rolling the tubular barrel such that the plurality of bands bends radially inward towards the rod.

18. The method of claim 16, wherein the angle of the slots relative to the central axis is selected such that the inner surface of the plurality of bands wipes an entire circumference of the pin when the pin is received by the plurality of bands.

19. The method of claim 16, further comprising dipping the tubular barrel into acid to de-burr the tubular barrel.

20. The method of claim 16, further comprising plating the tubular barrel.

* * * * *